US006313065B1

(12) United States Patent
Horsten et al.

(10) Patent No.: US 6,313,065 B1
(45) Date of Patent: Nov. 6, 2001

(54) SUBSTANTIALLY LIGHT-INSENSITIVE BLACK AND WHITE THERMOGRAPHIC RECORDING MATERIAL WITH IMPROVED IMAGE TONE

(75) Inventors: Bartholomeus Cyriel Horsten, Rumst; Guy Denis Jansen, Borsbeek; Peter Slabbinck, Knokke-Heist, all of (BE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/452,062

(22) Filed: Nov. 30, 1999

Related U.S. Application Data

(60) Provisional application No. 60/118,483, filed on Feb. 3, 1999.

(30) Foreign Application Priority Data

Nov. 30, 1998 (EP) ..... 98204016

(51) Int. Cl.[7] ..... B41M 5/40

(52) U.S. Cl. ..... 503/201; 503/200; 503/202; 503/212; 503/226

(58) Field of Search ..... 503/201, 202, 503/212, 226, 200

(56) References Cited

U.S. PATENT DOCUMENTS

| | | | |
|---|---|---|---|
| 5,468,603 | 11/1995 | Kub | 430/619 |
| 5,686,228 | 11/1997 | Murray et al. | 430/350 |
| 5,710,095 | 1/1998 | Horsten et al. | 503/210 |

*Primary Examiner*—Bruce H. Hess
(74) *Attorney, Agent, or Firm*—Leydig, Voit & Mayer, Ltd.

(57) ABSTRACT

A substantially light-insensitive black and white monosheet thermographic recording material comprising a support and a thermosensitive element provided with a protective layer, the thermosensitive element containing a substantially light-insensitive organic silver salt, a 1,2-dihydroxy-benzene derivative in thermal working relationship therewith and a first polymer having active hydrogen atoms at least part of which has reacted with a first polyisocyanate selected from the group consisting of: hexamethylene diisocyanate, toluene diisocyanate, diphenylmethane diisocyanat, naphthylene diisocyanate and triphenylmethane-p,p',p"-trityl triisocyanate; and the protective layer being exclusive of fluorine-containing compounds; and a thermographic recording process therefor.

8 Claims, No Drawings

SUBSTANTIALLY LIGHT-INSENSITIVE BLACK AND WHITE THERMOGRAPHIC RECORDING MATERIAL WITH IMPROVED IMAGE TONE

This application claims the benefit of U.S. Provisional Appln. No. 60/118,483 filed Feb. 3, 1999.

FIELD OF THE INVENTION

The present invention relates to improved substantially light-insensitive black and white monosheet thermographic recording materials.

BACKGROUND OF THE INVENTION

Thermal imaging or thermography is a recording process wherein images are generated by the use of thermal energy. In direct thermal thermography a visible image pattern is formed by image-wise heating of a recording material containing matter that by chemical or physical process changes colour or optical density. Most of the "direct" thermographic recording materials are of the chemical type. On heating to a certain conversion temperature, an irreversible chemical reaction takes place and a coloured image is produced.

U.S. Pat. No. 3,846,136 discloses that the thermosensitive or other hardenable layers in thermographic materials can be hardened with organic or inorganic hardening agents such as aldehydes and blocked aldehydes, ketones, carboxylic and carbonic acid derivatives, sulfonate esters, sulfonyl halides and vinyl sulfonyl ethers, active halogen compounds, epoxy compounds, aziridines, active olefins, isocyanates, carbodiimides, mixed function hardeners and polymeric hardeners such as oxidized polysaccharides like dialdehyde starch and oxy-guargum and the like. However, this disclosure is merely an invitation to experiment, because almost all hardening agents known for gelatino silver halide emulsion photographic-sensitive materials processed by wet treatment are enumerated and there is no example using them.

WO 95/12495 (=U.S. Pat. No. 5,710,095) discloses a method of recording an image by image-wise heating a recording material, the recording material comprising on the same side of a support, called the heat sensitive side, (1) one or more layers comprising an imaging composition essentially consisting of (i) a substantially light-insensitive organic silver salt being in thermal working relationship with (ii) a reducing agent, and (2) at the same side covering the imaging composition a protective layer, characterized in that the image-wise heating proceeds with a thermal head contacting the heat-sensitive side and through the protective layer mainly comprising a cured polymer or cured polymer composition. In a preferred embodiment thereof, the protective layer contains hydrophilic polymers having active hydrogen atoms at least part of which has reacted with hardening agents selected from the group consisting of polyisocyanates, polyepoxides, aldehydes and hydrolysed tetraalkyl orthosilicates.

U.S. Pat. No. 5,468,603 discloses a thermographic emulsion layer containing an organic silver salt, a polyisocyanate, a binder, e.g. BUTVAR™ B-79, and a large selection of reducing agents, with a sterically hindered bisphenols being preferred, provided with a protective layer comprising a polymeric fluorinated surfactant. DESMODUR™ 3300 is disclosed in U.S. Pat. No. 5,468,603 for photothermographic emulsion layers.

U.S. Pat. No. 5,468,228 discloses a thermographic emulsion layer containing an organic silver salt, a binder, e.g. BUTVAR™ B-79, a substituted propene compound and a large selection of reducing agents, with a sterically hindered bisphenosl being preferred. DESMODUR™ 3300 is disclosed in U.S. Pat. No. 5,468,228 for photothermographic emulsion layers.

In coating thermographic materials from solvents with protective layers it is desirable for economic and logistical reasons to coat the organic silver salt-containing layer simultaneously with a protective layer. This requires hardening of both layers to prevent significant interfacial mixing thereof. However, the use of such hardeners was found to affect significantly the image gradation of the resulting materials.

OBJECTS OF THE INVENTION

It is therefore an object of the present invention to provide a substantially light-insensitive black and white thermographic recording material with a hardened thermosensitive element.

It is therefore another object of the present invention to provide a substantially light-insensitive black and white thermographic recording materials which upon printing exhibits an image gradation which is not significantly affected by the thermosensitive element being hardened.

Further objects and advantages of the invention will become apparent from the description hereinafter.

SUMMARY OF THE INVENTION

Surprisingly it has been found that this adverse effect on image gradation upon hardening the thermosensitive element could be avoided by the use of 1,2-dihydroxy-benzene derivatives as reducing agents in combination with specific polyisocyanates as hardeners, the gradation of substantially light-insensitive black and white monosheet thermographic recording materials based on substantially light-insensitive organic silver salts and reducing agents therefor being substantially unaffected by the hardening process.

The above-mentioned objects are realized by a substantially light-insensitive black and white monosheet thermographic recording material comprising a support and a thermosensitive element provided with a protective layer, the thermosensitive element containing a substantially light-insensitive organic silver salt, a 1,2-dihydroxy-benzene derivative in thermal working relationship therewith and a first polymer having active hydrogen atoms at least part of which has reacted with a first polyisocyanate selected from the group consisting of: hexamethylene diisocyanate, toluene diisocyanate, diphenylmethane diisocyanat, naphthylene diisocyanate and triphenylmethane-p,p',p"-trityl triisocyanate; and the protective layer being exclusive of fluorine-containing compounds.

A recording process is further provided according to the present invention comprising the steps of: (i) bringing an outermost layer of the above-mentioned thermographic recording material in proximity with a heat source; and (ii) applying heat from the heat source imagewise to the recording material while maintaining proximity to the heat source to produce an image; and (iii) removing the recording material from the heat source.

Preferred embodiments of the invention are disclosed in the dependent claims.

DETAILED DESCRIPTION OF THE INVENTION

In a preferred embodiment of the recording process, according to the present invention, the heat source is a thermal head with a thin film thermal head being particularly preferred.

Definitions

By substantially light-insensitive is meant not intentionally light sensitive.

By substantially solvent-free aqueous medium is meant that solvent, if present, is present in amounts below 10% by volume of the aqueous medium. 1,2-dihydroxy-benzene derivatives are compounds having a benzene ring substituted with two hydroxy groups ortho to one another.

By a polymer having active hydrogen atoms is meant a polymer having substituents with hydrogen atoms which readily react such as hydroxy groups, thiol groups, carboxy groups, —N—H groups, amino groups, amido groups etc.

By polyisocyanate is meant a compound having at least two isocyanate groups which may or may not be blocked with groups which are readily displaced during a hardening process, wherein the polyisocyanate reacts with the active hydrogen atoms of a polymer having active hydrogen atoms.

The term fluorine-containing compounds includes all compounds containing fluorine and all compounds with fluorine-containing compounds as impurities and includes polymeric fluorinated surfactants such as disclosed in U.S. Pat. No. 5,468,603. U.S. Pat. No. 5,468,603 discloses a polymeric fluorinated surfactant containing at least three different groups within the polymer chain derived from reactive monomers, the monomers comprising: (a) a fluorinated, ethylenically unsaturated monomer; (b) a hydroxyl-containing, ethylenically unsaturated monomer; and (c) a polar, ethylenically unsaturated monomer; which is produced by addition copolymerization.

Reducing Agents

Suitable organic reducing agents according to the present invention are 1,2-dihydroxybenzene derivatives, such as catechol; 3-(3,4-dihydroxyphenyl) propionic acid; 3,4-dihydroxybenzoic acid and its esters; gallic acid and its esters e.g. methyl gallate, ethyl gallate, propyl gallate; tannic acid; 1,2-dihydroxy-naphthalene and 2,3-dihydroxynaphthalene.

In a preferred embodiment of the substantially light-insensitive black and white monosheet thermographic recording material of the present invention the 1,2-dihydroxybenzene derivative is a 3,4-dihydroxybenzoic acid derivative. In a further preferred embodiment of the substantially light-insensitive black and white monosheet thermographic recording material of the present invention the 1,2-dihydroxybenzene derivative is a compound represented by formula (I)

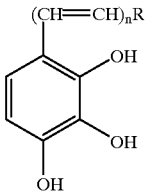

where n is 0 or 1; R is —(C═O)$R^1$, —(C═O)$NR^1R^2$, —CN, —$SO_3R^1$, —$SO_2R^1$, —$SOR^1$, —$SO_2NR^1R^2$ or —$PO_3R^1R^2$; $R^1$ is H or an alkyl or an aryl group; and $R^2$ is H or an alkyl or an aryl group; and $R^1$ and $R^2$ together can represent the atoms to close a ring, which can be a carbocyclic ring with all the ring atoms being carbon or a heterocyclic ring with the ring atoms being carbon and at least one non-carbon atom e.g. nitrogen, sulfur, oxygen, phosphorus etc. The alkyl and aryl groups can also be substituted with one or more groups selected from hydroxy, cyano, thiol and halogen. Particularly preferred —(CH═CH)$_n$R groups are formyl, oxo-alkyl, oxo-aryl, cyano, carbamido, diphenoxyphosphoryl, alkylsulfinyl, alkylsulfonyl and sulfonylamino groups.

Preferred reducing agents for use in the present invention are selected from the group consisting of: ethyl 3,4-dihydroxybenzoate, butyl 3,4-dihydroxybenzoate, 3,4-dihydroxybenzonitrile, 2,3,4-trihydroxy-acetophenone, 2,3,4-trihydroxy-propionophenone, 2,3,4-trihydroxybenzaldehyde, 2,3,4-trihydroxy-butyrophenone and 2,3,4-trihydroxybenzonitrile.

Combinations of reducing agents may also be used that on heating become reactive partners in the reduction of the substantially light-insensitive organic silver salt.

Polyisocyanates

The first polycyanate used in the thermosensitive elements of the substantially light-insensitive black and white monosheet thermographic recording material of the present invention is selected from the group consisting of: hexamethylene diisocyanate, toluene diisocyanate, diphenylmethane diisocyanat, naphthylene diisocyanate and triphenylmethane-p,p',p"-trityl triisocyanate.

Any polyisocyanate which reacts with polymers having active hydrogen atoms may be used for the second polyisocyanate e.g. a polyisocyanate with free isocyanate-groups or one with a blocking group to prevent reaction at room temperature. Suitable polyisocyanates include:

- hexamethylene diisocyanate derivatives (HDI) e.g. the biuret HDI's DESMODUR™ N100, DESMODUR™ N75 and the isocyanurates (HDI-trimers) from BAYER;
- toluene(2,4/2,6)-diisocyanate derivatives (TDI) e.g. DESMODUR™ L75, a product of diisocyantotoluene and trimethylolpropane from BAYER;
- 4,4'-diisocyanatodiphenylmethane (MDI) e.g. DESMODUR™ VL from BAYER;
- naphthylene 1,5-diisocyanate (NDI);
- p-phenylene diisocyanate (PPDI);
- m-xylylene diisocyanate (XDI);
- cyclohexane diisocyanate (CHDI) e.g. DESMODUR™ W from BAYER;
- triphenylmethane triisocyanate e.g. DESMODUR™ R from BAYER;
- triphenylmethane-p,p',p"-trityl triisocyanate; and
- polymeric isocyanates (PMDI).

The choice of polyisocyanate is dependent upon the rate of hardening required.

The first and second polyisocyanates may be the same or different.

Thermosensitive Element

The thermosensitive element, according to the present invention, contains a substantially light-insensitive organic silver salt, a 1,2-dihydroxybenzene derivative in thermal working relationship therewith and a polymer having active hydrogen atoms at least part of which has reacted with a first polyisocyanate. The element may comprise a layer system in which the ingredients may be dispersed in different layers, with the proviso that the substantially light-insensitive organic silver salt is in reactive association with the 1,2-dihydroxybenzene derivative i.e. during the thermal development process the 1,2-dihydroxybenzene derivative must be present in such a way that it is able to diffuse to the particle of substantially light-insensitive organic silver salt so that reduction to silver can occur. The thermosensitive element is preferably exclusive of a substituted propenenitrile compound of the formula $(X)NC{=}R^1R^2$ where $R^1$ represents a hydroxy group or a metal salt of a hydroxy group; $R^2$ represents an akyl group or an aryl group; and X represents an electron withdrawing group; or $R^2$ and X taken together can form a ring containing the electron withdrawing group as disclosed in U.S. Pat. No. 5, 686,228.

Organic Silver Salts

Preferred substantially light-insensitive organic silver salts for use in the thermosensitive element of the substantially light-insensitive black and white thermographic recording material used in the present invention, are silver salts of aliphatic carboxylic acids known as fatty acids, wherein the aliphatic carbon chain has preferably at least 12 C-atoms, which silver salts are also called "silver soaps". Combinations of different organic silver salts may also be used in the imaging materials of the present invention.

Toning Agents

In order to obtain a neutral black image tone in the higher densities and neutral grey in the lower densities, the thermosensitive element preferably further contains a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446, 648 and 3,844,797. Other particularly useful toning agents; are the heterocyclic toner compounds of the benzoxazine dione or naphthoxazine dione type as disclosed in GB-P 1,439,478, U.S. Pat. Nos. 3,95,1,660 and 5,599,647.

Polymer Having Active Hydrogen Atoms

The first polymer having active hydrogen atoms of the thermosensitive element and the second polymer having active hydrogen atoms of the protective layer may be all kinds of natural, modified natural or synthetic resins or mixtures of such resins, in which the particles of organic silver salt can be dispersed homogeneously either in aqueous or solvent media: e.g. cellulose derivatives such as ethylcellulose, cellulose esters, e.g. cellulose nitrate, carboxymethylcellulose, starch ethers, partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, polyacrylamide, polymethacrylamide, polyacrylic acid, polymethacrylic acid, proteinaceous binders such as gelatin, modified gelatins such as phthaloyl gelatin, polysaccharides, such as starch, gum arabic and dextran and water-soluble cellulose derivatives or mixtures thereof.

In a preferred embodiment of the substantially light-insensitive black and white monosheet thermographic recording material of the present invention the first polymer having active hydrogen atoms is selected from the group consisting of polyvinyl alcohol, polyvinyl acetals and proteinaceous binders.

The binder to organic silver salt weight ratio in the thermosensitive element is preferably in the range of 0.2 to 6, and the thickness of the thermosensitive element is preferably in the range of 5 to 50 $\mu$m.

Stabilizers and Antifoggants

In order to obtain improved shelf-life and reduced fogging, stabilizers and antifoggants may be incorporated into the substantially light-insensitive black and white thermographic recording material used in the present invention. Suitable stabilizers compounds for use in the present invention are unsaturated carbocyclic or heterocyclic compounds substituted with a —SA group where A is hydrogen, a counterion to compensate the negative charge of the thiolate group or a group forming a symmetrical or an asymmetrical disulfide. Such stabilizers may be further substituted, which substitution also includes the atoms necessary to form an annulated unsaturated carbocyclic or heterocyclic ring system. Preferred stablizer compounds used in the present invention have an unsaturated 5- or 6-membered ring. Particularly suitable compounds are represented by formula (II):

(II)

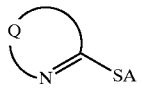

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive black and white thermographic recording material used in the present invention may contain one or more surfactants, which may be anionic, non-ionic or cationic surfactants and/or one or more dispersants.

Suitable dispersants are natural polymeric substances, synthetic polymeric substances and finely divided powders, for example finely divided non-metallic inorganic powders such as silica.

Other Ingredients

In addition to the ingredients the substantially light-insensitive black and white thermographic recording material may contain other additives such as free fatty acids, antistatic agents, e.g. non-ionic antistatic agents, silicone oil, ultraviolet light absorbing compounds, white light reflecting and/or ultraviolet radiation reflecting pigments, silica, and/or optical brightening agents.

Support

The support of the substantially light-insensitive black and white thermographic recording material used in the present invention may be transparent or translucent and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

According to a preferred embodiment of the substantially light-insensitive black and white monosheet thermographic recording material of the present invention protective layer contains a second polymer having active hydrogen atoms and a second polyisocyanate. In general this protects the thermosensitive element from atmospheric humidity and from surface damage by scratching etc. and prevents direct contact of printheads or heat sources with the recording layers. Fluorine-containing compounds are undesirable in the protective layer, because at the high temperatures obtained in the protective layer during the thermal development such compounds react with other ingredients and/or degrade to volatile fluorine-containing compounds which attack the thermal head thereby considerably reducing its operating lifetime.

Protective layers for thermosensitive elements which come into contact with and have to be transported past a heat source under pressure, have to exhibit resistance to local deformation and good slipping characteristics during transport past the heat source during heating.

Solid or liquid lubricants or combinations thereof are suitable for improving the slip characteristics of the thermographic recording materials according to the present invention. Solid lubricants which can be used according to the present invention are polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199. Liquid lubricants which can be used according to the present invention according to the present invention are fatty acid esters such as glycerine trioleate, sorbitan monooleate and sorbitan trioleate, silicone oil derivatives and phosphoric acid derivatives.

The protective layer of the recording material according to the present invention may comprise a matting agent. Suitable matting agents are described in WO 94/11198 and include e.g. talc particles and optionally protrude from the protective layer.

Antihalation Dyes

In addition to the ingredients, the thermographic recording materials used in the present invention may also contain antihalation or acutance dyes which absorb infra-red light, for absorption by a dye which converts the absorbed infra-red light into heat, which has passed through the thermosensitive element thereby preventing its reflection. Such dyes may be incorporated into the thermosensitive element or in any other layer of the recording material of the present invention.

Coating Techniques

The coating of any layer of the substantially light-insensitive black and white thermographic recording material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

Thermographic Printing

Direct thermal imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly or from an intermediary storage means, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulsewise. When used in thermographic recording operating with thermal printheads the imaging materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixel-wise modulated ultra-sound.

Industrial Application

Thermographic imaging can be used for the production of transparencies and reflection type prints. Application of the present invention is envisaged in the fields of both graphics images requiring high contrast images with a very steep dependence of print density upon applied dot energy and continuous tone images requiring a weaker dependence of print density upon applied dot energy, such as required in the medical diagnostic field. In the hard copy field thermographic recording materials on a white opaque base are used, whereas in the medical diagnostic field black-imaged transparencies are widely used in inspection techniques operating with a light box.

The invention is illustrated hereinafter by way of invention examples and comparative examples. The percentages and ratios given in these examples are by weight unless otherwise indicated. The ingredients used in the invention and comparative examples, other than those mentioned above, are:

in the thermosensitive element:

organic silver salt:

AgBeh=silver behenate;

the binder:

BR 18=PIOLOFORM BR 18, a polyvinyl butyral from WACKER CHEMIE;

polyisocyananates:

N100=DESMODUR™ N100 from BAYER;

N75=DESMODUR™ N75 from BAYER;

N3300=DESMODUR™ N3300 from BAYER

W=DESMODUR™ W from BAYER;

L75=DESMODUR™ L75, a toluene diisocyanate (TDI) from BAYER;

VL=DESMODUR™ VL a 4,4'-diisocyanatodiphenylmethane from BAYER;

catalyst for polyisocyanate hardening:

DBTDL=dibutyltin dilaurate other hardeners:

CYMEL™ 303=a highly methylated melamine resins, from DYNO-CYTEC Industries;

CYCAT™ 600=dodecyl benzene sulfonic acid, from DYNO-CYTEC Industries;

reducing agent:

R01=ethyl 3,4-dihydroxybenzoate;

R02=propyl 2,3,4-trihydroxybenzoate (propyl gallate);

R03=methyl 3,4-dihydroxy-5-methoxybenzoate;

R04=2,3,4-trihydroxy-propionophenone;

R05=propyl 3,4-dihydroxy-5-methoxybenzoate;

R06=

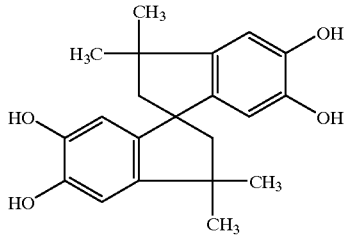

R07=2,3,4-trihydroxy-butyrophenone;

R08=1,1-bis(2-hydroxy-3,5-dimethylphenyl)-3,5,5-trimethylhexane, NONOX™;

toning agents:

T01=7-(ethylcarbonato)-benzo[e][1,3]oxazine-2,4-dione;

silicone oil:

Oil=BAYSILON™ MA, a polydimethylsiloxane from BAYER;

stabilizers:

S01=tetrachlorophthalic anhydride;

S02=3'-decanoylamino-1-phenyl-1H-tetrazole-5-thiol

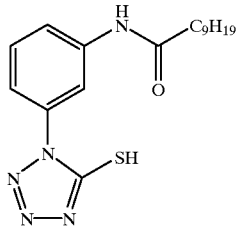

and in the protective layer the following additional ingredients:

MICRODOL™ SUPER, a talc from Norwegian Talc AS;

TINUVIN™ 320 from CIBA-GEIGY;

SERVOXYL™ VPAZ 100, a mixture of monolauryl and dilauryl phosphate from SERVO DELDEN B.V.

INVENTION EXAMPLES 1 to 5 and

Comparative Example 1

Preparation of a Silver Behenate Dispersion 72 kg of a 25% solution of BR 18 in 2-butanone, 180 kg of silver behenate and 455 kg 2-butanone were mixed for in a ball mill. After 4 days 72 kg of a 25% solution of BR 18 in 2-butanone and 22 kg of 2-butanone were added and then mixed in the ball mill for several days more. 576 kg of a 25% solution of BR 18 in 2-butanone, 0.684 kg of oil, 326.2 kg of 2-butanone and 10.08 g of T01 were then added and the mixture further mixed for 10 hours in the ball mill. The final 2-butanone dispersion contained 10.5% of silver behenate, 10.5% of BR 18, 0.59% of T01 and 0.04% of oil.

Preparation of the Thermosensitive Element

The subbed 120 μm thick polyethylene terephthalate support was doctor blade-coated with a composition containing 2-butanone as solvent/dispersing medium so as to obtain thereon, after drying, a thermosensitive element with the compositions in table 1 below:

TABLE 1

| | | Comparative example 1 | Invention example 1 | Invention example 2 | Invention example 3 | Invention example 4 | Invention example 5 |
|---|---|---|---|---|---|---|---|
| AgBeh coverage [g/m²] | | 6.32 | 6.32 | 6.32 | 6.32 | 6.32 | 6.32 |
| reducing agent | types | R01/R02 | R01/R02 | R01/R02 | R01/R02 | R01/R02 | R01/R02 |
| | [g/m²] | 0.796/ 0.929 | 0.796/ 0.929 | 0.796/ 0.929 | 0.796/ 0.929 | 0.796/ 0.929 | 0.796/ 0.929 |

TABLE 1-continued

| | | Comparative example 1 | Invention example 1 | Invention example 2 | Invention example 3 | Invention example 4 | Invention example 5 |
|---|---|---|---|---|---|---|---|
| BR 18 | [g/m$^2$] | 6.32 | 6.32 | 6.32 | 6.32 | 6.32 | 6.32 |
| hardener | type | CYMEL 303/ CYCAT 600 | VL | W | N100 | N3300 | L75 |
| | [g/m$^2$] | 2.893/0.579 | 1.45 | 1.45 | 1.45 | 1.45 | 1.45 |
| Oil | [g/m$^2$] | 0.024 | 0.024 | 0.024 | 0.024 | 0.024 | 0.024 |
| T01 | [g/m$^2$] | 0.355 | 0.355 | 0.355 | 0.355 | 0.355 | 0.355 |
| S01 | [g/m$^2$] | 0.156 | 0.156 | 0.156 | 0.156 | 0.156 | 0.156 |
| S02 | [g/m$^2$] | 0.142 | 0.142 | 0.142 | 0.142 | 0.142 | 0.142 |

Evaluation of the Degree of Hardening

The degree of hardening was determined by allowing a drop of 2-butanone to be absorbed by the thermosensitive element, then wiping the film to remove softening areas and finally uniformly heating the thermographic recording material. Insufficient hardening is shown by regions of the thermographic recording material exhibiting no development due to the softening and removal of the binder containing the silver behenate. The results were evaluated by a visual evaluation:

no undeveloped areas=excellent hardening slight blemishes=acceptable hardening large areas undeveloped=poor hardening The results are summarised in table 2.

TABLE 2

| hardening conditions | | results of degree of hardening test | | | | | |
|---|---|---|---|---|---|---|---|
| temperature [° C.] | time [min] | Comparative example 1 | VL Invention example 2 | W Invention example 2 | N100 Invention example 3 | N3300 Invention example 4 | L75 Invention example 5 |
| 20 | 0 | excellent | excellent | | | acceptable | |
| 20 | 180 | excellent | excellent | | | acceptable | excellent |
| 20 | 480 | excellent | excellent | | excellent | acceptable | excellent |
| 80 | 3 | excellent | excellent | | acceptable | excellent | excellent |
| 85 | 1 | excellent | excellent | | | excellent | acceptable |
| 85 | 3 | excellent | excellent | acceptable | excellent | excellent | excellent |
| 90 | 1 | excellent | excellent | | excellent | excellent | excellent |

These results show that acceptable hardening was achieved with all the polyisocyanates evaluated and with the CYMEL™ 303/CYCAT™ 600 combination.

Thermographic Printing

During printing of the recording materials of COMPARATIVE EXAMPLE 1 and INVENTION EXAMPLES 1 to 5 the print head was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$m.

The printer was equipped with a thin film thermal head with a resolution of 300 dpi and was operated with a line time of 6.5 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of COMPARATIVE EXAMPLE 1 and INVENTION EXAMPLES 1 to 5.

The maximum and minimum densities of the prints given in table 3 were measured through a visible filter with a MACBETH™ TR924 densitometer in the grey scale step corresponding to data levels of 64 and 0 respectively and are given in table 3.

For evaluating the steepness of the gradation of the thermographic recording materials of COMPARATIVE EXAMPLE 1 and INVENTION EXAMPLES 1 to 5 the numerical gradation value (NGV) corresponding with the quotient of the fraction $[2.5-(1.0+D_{min})]/[E_{2.5}-E_{(1.0+Dmin)}]$ was determined, wherein $E_{2.5}$ is the energy in Joule applied in a dot area of 87 $\mu$m×87 $\mu$m of the imaging layer that obtains by the energy an optical density value of 2.5, and $E_{(}1.0+Dmin)$ is the energy in Joule applied in a dot area of the imaging layer material that obtains by the energy an optical density value of $(1.0+D_{min})$. The applied energy in Joule is actually the electrical input energy measured for each resistor of the thermal head. The NGV's for the thermographic recording materials of COMPARATIVE EXAMPLE 1 and INVENTION EXAMPLES 1 to 5 are given in table 3.

Shelf-life Test

The shelf-life of the thermographic recording materials of COMPARATIVE EXAMPLE 1 and INVENTION EXAMPLES 1 to 5 was evaluated on the basis of the observed changes in maximum density, $\Delta D_{max}$, and the change in the CIELAB a* and b* values at the minimum density. The CIELAB-values were determined by spectrophotometric measurements according to AST M Norm E179-90 in a R(45/0) geometry with evaluation according to ASTM Norm E308-90. The results are summarized in table 3.

TABLE 3

| | reducing agent nr | | print after hardening at 85° C. for 3 min. $D_{max}/D_{min}$ (vis) | NGV | print with fresh material at $D_{min}$ a* | b* | Shelf-life after 3d at 57° C./34% RH $\Delta D_{min}$ (vis) | at $D_{min}$ a* | b* |
|---|---|---|---|---|---|---|---|---|---|
| Comparative example number | | | | | | | | | |
| 1 | R01/R02 | CYMEL303/ CYCAT600 | 3.50/0.06 | 12.8 | 0.06 | 1.82 | 0.05 | 0.30 | 2.17 |
| Invention example number | | | | | | | | | |
| 1 | R01/R02 | VL | 3.94/0.05 | 17.4 | −0.21 | 2.18 | 0.05 | −0.39 | 3.75 |
| 2 | R01/R02 | W | 4.11/0.06 | 18.2 | −0.17 | 2.12 | 0.05 | 0.12 | 2.01 |
| 3 | R01/R02 | N100 | 3.88/0.06 | 17.0 | −0.06 | 1.63 | 0.05 | 0.25 | 2.27 |
| 4 | R01/R02 | N3300 | 3.90/0.06 | 18.2 | 0.07 | 1.69 | 0.06 | 0.22 | 2.59 |
| 5 | R01/R02 | L75 | 4.01/0.06 | 18.4 | −0.05 | 1.69 | 0.05 | −0.10 | 2.89 |

The results in table 3 show that after hardening for 3 minutes at 85° C., sufficient for acceptable hardening with all the hardening systems evaluated, acceptable $D_{max}$- and $D_{min}$-values were obtained with all the hardening systems evaluated and the image tone as evaluated by CIELAB—measurements both after hardening and after 3 days at 57° C. and 34% relative humidity were comparable, but the NGV-value with on-polyisocyanate hardening system of COMPARATIVE EXAMPLE 1 was significantly lower at 12.8 than that attained with the polyisocyanate hardeners: 17.0 to 18.4 and hence significantly less interference between the hardening system and the ingredients involved in image formation. The highest NGV-values indicating the least interference was found with the polyisocyanates: DESMODUR™ N3300, DESMODUR™ L75 and DESMODUR™ W.

It is clear from the NGV-values for INVENTION EXAMPLES 1 to 5 compared with the NGV-value for COMPARATIVE EXAMPLE 1, that although the melamine-hardening system CYMEL 303/CYCAT 600 hardens efficiently, the NGV-value is considerably lower than that obtained using the polyisocyanate hardeners. This indicates a much greater degree of reaction between the CYMEL 303/CYCOAT 600-hardening system and the combination of the 1,2-dihydroxybenzene reducing agents, R01 and R02, used, than is the case with polyisocyanate hardeners.

INVENTION EXAMPLES 6 to 11

The thermosensitive elements of the substantially light-insensitive black and white monosheet thermographic recording materials of INVENTION EXAMPLES 6 to 11 were produced as described for INVENTION EXAMPLES 1 to 5 and COMPARATIVE EXAMPLE 1 except as given in table 4 below.

TABLE 4

| | Invention example 6 | Invention example 7 | Invention example 8 | Invention example 9 | Invention example 10 | Invention example 11 |
|---|---|---|---|---|---|---|
| AgBeh coverage [g/m²] | 5.61 | 5.58 | 5.74 | 5.58 | 5.72 | 5.85 |
| reducing agent | | | | | | |
| types | R01/R02 | R04 | R01/R04 | R01/R04 | R01/R04 | R01/R04 |
| [g/m²] | 0.706/ 0.824 | 1.316 | 0.361/ 1.083 | 0.469/ 0.921 | 0.599/ 0.808 | 0.736/ 0.689 |
| BR 18 [g/m²] | 5.61 | 5.58 | 5.74 | 5.58 | 5.72 | 5.85 |
| L75 [g/m²] | 0.642 | 0.639 | 0.657 | 0.725 | 0.654 | 0.669 |
| DBTDL | 0.013 | 0.013 | 0.013 | 0.013 | 0.013 | 0.013 |
| Oil [g/m²] | 0.021 | 0.021 | 0.022 | 0.021 | 0.022 | 0.022 |
| T01 [g/m²] | 0.315 | 0.313 | 0.322 | 0.313 | 0.321 | 0.329 |
| S01 [g/m²] | 0.139 | 0.138 | 0.142 | 0.138 | 0.141 | 0.144 |
| S02 [g/m²] | 0.126 | 0.125 | 0.129 | 0.125 | 0.128 | 0.131 |

The thermosensitive elements of the thermographic recording materials of INVENTION EXAMPLES 6 to 11 were then overcoated with the following protective layer composition:

| | |
|---|---|
| PIOLOFORM BR 18 | 1.5 g/m² |
| MICRODOL ™ SUPER | 0.18 g/m² |

-continued

| | |
|---|---|
| BAYSILON ™ MA | 0.012 g/m$^2$ |
| DESMODUR ™ VL | 0.15 g/m$^2$ |

Thermographic evaluation of the substantially light-insensitive black and white monosheet thermographic recording materials of INVENTION EXAMPLES 6 to 11 was carried out as described for INVENTION EXAMPLES 1 to 5 and COMPARATIVE EXAMPLE 1 except that the printhead was not separated from the outermost layer on the same side of the support as the thermosensitive element by the thin intermediate material. The results are summarized in table 5.

The use of R04, a reducing agent according to formula (I), or a combination of R04 with ethyl 3,4-dihydroxybenzoate, R01, in thermographic recording materials with the thermosensitive element and protective layer hardened with a polyisocyanate produces thermographic recording materials (INVENTION EXAMPLES 7 to 11) whose prints exhibit a significantly steeper sensitometry than an analogous thermographic recording material (INVENTION EXAMPLE 6) using the reducing agent combination RO1 and R02.

TABLE 5

| Invention example number | reducing agent nr | Polyisocyanate | print after coating $D_{max}/D_{min}$ (vis) | NGV | at $D_{min}$ a* | b* | Shelf-life after 3d at 57° C./35% RH $\Delta D_{max}/\Delta D_{min}$ (vis) | at $D_{min}$ a* | b* |
|---|---|---|---|---|---|---|---|---|---|
| 6 | R01/ R02 | L75/ VL | 3.64/ 0.05 | 14.54 | −0.06 | 2.36 | −0.43/ +0.01 | 0.08 | 3.58 |
| 7 | R04 | L75/ VL | 3.87/ 0.05 | 16.42 | −0.36 | 3.37 | −1.14/ +0.01 | −0.40 | 3.99 |
| 8 | R01/ R04 | L75/ VL | 3.94/ 0.05 | 16.08 | −0.42 | 3.35 | −0.51/ 0.00 | −0.36 | 4.24 |
| 9 | R01/ R04 | L75/ VL | 3.90/ 0.05 | 15.89 | −0.40 | 3.27 | −0.60/ +0.01 | −0.32 | 4.22 |
| 10 | R01/ R04 | L75/ VL | 3.92/ 0.05 | 15.41 | −0.39 | 3.30 | −0.73/ 0.00 | −0.33 | 3.89 |
| 11 | R01/ R04 | L75/ VL | 4.07/ 0.05 | 17.35 | −0.33 | 3.19 | −0.50/ +0.01 | −0.32 | 4.25 |

INVENTION EXAMPLES 12 to 17

The thermosensitive elements of the substantially light-insensitive black and white monosheet thermographic recording materials of INVENTION EXAMPLES 12 to 17 were produced as described for INVENTION EXAMPLES 1 to 5 and COMPARATIVE EXAMPLE 1 except as given in table 6 below.

TABLE 6

| | Invention example 12 | Invention example 13 | Invention example 14 | Invention example 15 | Invention example 16 | Invention example 17 |
|---|---|---|---|---|---|---|
| AgBeh coverage [g/m$^2$] | 5.85 | 5.77 | 5.93 | 5.69 | 5.74 | 5.80 |
| reducing agent | | | | | | |
| types | R01/R02 | R06 | R01/R06 | R01/R06 | R01/R06 | R01/R06 |
| [g/m$^2$] | 0.736/ 0.859 | 2.481 | 0.248/ 1.854 | 0.4781 1.562 | 0.602/ 1.347 | 0.729/ 1.134 |
| BR 18 [g/m$^2$] | 5.85 | 5.77 | 5.93 | 5.69 | 5.74 | 5.80 |
| L75 [g/m$^2$] | 0.669 | 0.660 | 0.678 | 0.651 | 0.657 | 0.663 |
| DBTDL | 0.013 | 0.013 | 0.014 | 0.013 | 0.013 | 0.013 |
| Oil [g/m$^2$] | 0.022 | 0.022 | 0.023 | 0.022 | 0.022 | 0.022 |
| T01 [g/m$^2$] | 0.329 | 0.324 | 0.333 | 0.320 | 0.322 | 0.326 |
| S01 [g/m$^2$] | 0.144 | 0.143 | 0.146 | 0.141 | 0.142 | 0.143 |
| S02 [g/m$^2$] | 0.131 | 0.129 | 0.133 | 0.128 | 0.129 | 0.130 |

The thermosensitive elements of the thermographic recording materials of INVENTION EXAMPLES 12 to 17 were then overcoated with the same protective layer composition as used for the thermographic recording materials of INVENTION EXAMPLES 6 to 11.

Thermographic evaluation of the substantially light-insensitive black and white monosheet thermographic recording materials of INVENTION EXAMPLES 6 to 11 was carried out as described for INVENTION EXAMPLES 1 to 5 and COMPARATIVE EXAMPLE 1 except that the printhead was not separated from the outermost layer on the same side of the support as the thermosensitive element by the thin intermediate material. The results are summarized in table 7.

TABLE 7

| Invention example number | reducing agent nr | Polyisocyanate | print after coating $D_{max}/D_{min}$ (vis) | NGV | at $D_{min}$ a* | b* | Shelf-life after 3d at 57° C./34% RH $\Delta D_{max}/\Delta D_{min}$ (vis) | at $D_{min}$ a* | b* |
|---|---|---|---|---|---|---|---|---|---|
| 12 | R01/R02 | L75/VL | 4.25/0.05 | 16.1 | −0.15 | 2.75 | −0.55/0.00 | 0.33 | 3.62 |
| 13 | R06 | L75/VL | 2.48/0.05 | – | −0.37 | 4.18 | −0.59/0.00 | −0.41 | 4.55 |
| 14 | R01/R06 | L75/VL | 3.07/0.05 | – | −0.23 | 3.23 | −0.70/−0.01 | −0.10 | 3.28 |
| 15 | R01/R06 | L75/VL | 3.48/0.05 | 11.9 | −0.26 | 3.21 | −0.84/0.00 | 0.01 | 3.47 |
| 16 | R01/R06 | L75/VL | 3.67/0.05 | 13.3 | −0.30 | 3.13 | −0.77/0.00 | 0.02 | 3.41 |
| 17 | R01/R06 | L75/VL | 3.86/0.05 | 15.1 | −0.24 | 2.98 | −0.71/0.00 | 0.02 | 3.26 |

The use of R06, a spiroindane reducing agent, or a combination of R06 with ethyl 3,4-dihydroxybenzoate, R01, in thermographic recording materials with the thermosensitive element and protective layer hardened with a polyisocyanate produces thermographic recording materials (INVENTION EXAMPLES 13 to 17) whose prints it a slightly less steep sensitometry than an analogous thermographic recording material (INVENTION EXAMPLE 12) using the reducing agent combination R01 and R02. However, for the R01/R06 combinations $D_{min}$ is significantly less yellow as can be seen by CIELAB-a* values being much closer to zero after 3 days at 57° C. and 34% relative humidity.

INVENTION EXAMPLES 18 to 21

The thermosensitive elements of the substantially light-insensitive black and white monosheet thermographic recording materials of INVENTION EXAMPLES 18 to 21 were produced as described for INVENTION EXAMPLES 1 to 5 and COMPARATIVE EXAMPLE 1 except as given in table 8 below.

TABLE 8

| | Invention example 18 | Invention example 19 | Invention example 20 | Invention example 21 |
|---|---|---|---|---|
| AgBeh coverage [g/m²] | 6.32 | 6.32 | 6.32 | 6.32 |
| reducing agent | | | | |
| types | R01/R02 | R01/R02 | R01/R02 | R01/R02 |
| [g/m²] | 1.105/0.155 | 1.105/0.155 | 1.105/0.155 | 1.105/0.155 |
| BR 18 [g/m²] | 6.32 | 6.32 | 6.32 | 6.32 |
| polyisocyanate | | | | |
| type | N75 | VL | N100 | N3300 |
| [g/m²] | 1.45 | 1.45 | 1.45 | 1.45 |

TABLE 8-continued

| | Invention example 18 | Invention example 19 | Invention example 20 | Invention example 21 |
|---|---|---|---|---|
| Oil [g/m²] | 0.024 | 0.024 | 0.024 | 0.024 |
| T01 [g/m²] | 0.355 | 0.355 | 0.355 | 0.355 |
| S01 [g/m²] | 0.156 | 0.156 | 0.156 | 0.156 |
| S02 [g/m²] | 0.142 | 0.142 | 0.142 | 0.142 |

Thermographic evaluation of the substantially light-insensitive black and white monosheet thermographic recording materials of INVENTION EXAMPLES 18 to 21 were carried out as described for INVENTION EXAMPLES 1 to 5 and COMPARATIVE EXAMPLE 1. The results are summarized in table 9.

TABLE 9

| Invention example number | reducing agent nr | Polyisocyanate | print after hardening at 85° C. for 3 minutes $D_{max}D_{min}$ (vis) | NGV | print with fresh material at $D_{min}$ a* | b* | Shelf-life after 3d at 57° C./34% RH $\Delta D_{min}$ (vis) | at $D_{min}$ a* | b* |
|---|---|---|---|---|---|---|---|---|---|
| 18 | R01/R02 | N75 | 3.25/0.05 | 11.82 | −0.21 | 2.18 | 0.05 | −0.39 | 3.75 |
| 19 | R01/R02 | VL | 2.54/0.04 | – | −0.17 | 2.12 | 0.05 | 0.12 | 2.01 |
| 20 | R01/R02 | N100 | 2.76/0.04 | 11.58 | −0.06 | 1.63 | 0.05 | 0.25 | 2.27 |
| 21 | R01/R02 | N3300 | 3.04/0.04* | 14.30* | 0.07 | 1.69 | 0.06 | 0.22 | 2.59 |

*after hardening at 90° C. for 3 minutes

These results show a significantly higher NGV-value for thermographic recording materials produced using DESMODUR™ N3300 than with DESMODUR™ VL, N75 or N100.

INVENTION EXAMPLES 21 to 27

The thermosensitive elements of the substantially light-insensitive black and white monosheet thermographic recording materials of INVENTION EXAMPLES 21 to 27 were produced in an analogous way to that described for INVENTION EXAMPLES 1 to 5 and COMPARATIVE EXAMPLE 1 except that the thermosensitive element composition was that given below:

| | |
|---|---|
| AgBeh | 3.89 [g/m$^2$] |
| R01, reducing agent | 0.855 [g/m$^2$] |
| PIOLOFORM ™ BR 18 | 3.89 [g/m$^2$] |
| DESMODUR ™ N100 | 0.401 [g/m$^2$] |
| Oil | 0.144 [g/m$^2$] |
| TINUVIN ™ 320 | 0.15 [g/m$^2$] |
| T01 | 0.219 [g/m$^2$] |
| S01 | 0.235 [g/m$^2$] |
| S02 | 0.085 [g/m$^2$] |

The thermosensitive element used in the thermographic recording materials of INVENTION EXAMPLES 21 to 27 was then overcoated with different protective layer compositions given in table 10.

Thermographic evaluation of the substantially light-insensitive black and white monosheet thermographic recording materials of INVENTION EXAMPLES 21 to 27 was carried out as described for INVENTION EXAMPLES 1 to 5 and COMPARATIVE EXAMPLE 1 except that the printhead was not separated from the outermost layer on the same side of the support as the thermosensitive element by the thin intermediate material and the NGV values were evaluated for the optical density range ($0.3+D_{min}$) to ($1.0+D_{min}$) instead of the optical density range ($1.0+D_{min}$) to ($2.5+D_{min}$. This is justified by the lower coverage of silver behenate in the thermosensitive element than for the thermosensitive elements of the thermographic recording materials of COMPARATIVE EXAMPLE 1 and INVENTION EXAMPLES 1 to 20. The results are summarized in table 11.

The image tone of the thermographic recording material of INVENTION EXAMPLE 21 with DESMODUR™ N100 in the protective layer was significantly better than those attained with the thermographic recording materials of INVENTION EXAMPLES 22 to 27 with DESMODUR™ VL. Furthermore, the amount of DESMODUR™ VL used in the protective layers of the thermographic recording materials of INVENTION EXAMPLES 22 to 27 was found to have little influence on the NGV-values observed and increasing the amount of DESMODUR™ VL used resulted in significantly less increase in the CIELAB-b* value upon heating for 24 hours at 80° C.

TABLE 10

| | Invention example 21 | Invention example 22 | Invention example 23 | Invention example 24 | Invention example 25 | Invention example 26 | Invention example 27 |
|---|---|---|---|---|---|---|---|
| BR 18 [g/m$^2$] | 1.844 | 1.844 | 1.844 | 1.844 | 1.844 | 1.844 | 1.844 |
| Oil [g/m$^2$] | 0.012 | 0.012 | 0.012 | 0.012 | 0.012 | 0.012 | 0.012 |
| MICRODOL SUPER [g/m$^2$] | 0.184 | 0.184 | 0.184 | 0.184 | 0.184 | 0.184 | 0.184 |
| TINUVIN ™ 320 | 0.228 | 0.228 | 0.228 | 0.228 | 0.228 | 0.228 | 0.228 |
| polyisocyanate | | | | | | | |
| type | N100 | VL | VL | VL | VL | VL | VL |
| [g/m$^2$] | 0.183 | 0.183 | 0.229 | 0.274 | 0.32 | 0.366 | 0.413 |
| Servoxyl VDAZ 100 | 0.15 | 0.15 | 0.15 | 0.15 | 0.15 | 0.15 | 0.15 |

TABLE 11

| Invention example number | reducing agent nr | polyisocyanate | print with fresh material $D_{max}/D_{min}$ (vis) | NGV* | print with fresh material at $D_{min}$ a* | b* | Shelf-life after 24h at 80° C. at $D_{min}$ a* | b* |
|---|---|---|---|---|---|---|---|---|
| 21 | R01 | N100 | 2.13/0.04 | 9.67 | −0.67 | 3.0 | −0.04 | 15.24 |
| 22 | R01 | VL | 1.95/0.04 | 10.05 | −0.77 | 3.31 | 3.66 | 15.46 |
| 23 | R01 | VL | 1.91/0.04 | 9.28 | −0.76 | 3.33 | 0.2 | 10.73 |
| 24 | R01 | VL | 1.94/0.04 | 9.69 | −0.71 | 2.96 | 0.12 | 10.64 |
| 25 | R01 | VL | 1.91/0.04 | 8.78 | −0.79 | 3.46 | 0.6 | 11.13 |
| 26 | R01 | VL | 2.10/0.04 | 9.36 | −0.75 | 3.61 | 0.69 | 10.23 |
| 27 | R01 | VL | 1.87/0.04 | 9.09 | −0.79 | 3.44 | 0.93 | 8.83 |

*in the optical density range (0.3 + Dmin) to (1.0 + Dmin)

Having described in detail preferred embodiments of the current invention, it will now be apparent to those skilled in the art that numerous modifications can be made therein without departing from the scope of the invention as defined in the following claims.

What is claimed is:

1. A substantially light-insensitive black and white mono sheet thermographic recording material comprising a support and a thermosensitive element provided with a protective layer, said thermosensitive element containing a substantially light-insensitive organic silver salt, a 1,2-dihydroxy-benzene derivative in thermal working relationship therewith and a polymer having active hydrogen atoms at least part of which has reacted with a polyisocyanate selected from the group consisting of: hexamethylene diisocyanate, toluene diisocyanate, diphenylmethane diisocyanate, naphthylene diisocyanate and triphenylmethane-p, p', p"-trityl triisocyanate; wherein said protective layer being exclusive of fluorine-containing compounds and wherein said thermosensitive element being exclusive of propenenitrile compounds.

2. Thermographic recording material according to any of claim 1, wherein said 1,2-dihydroxybenzene derivative is a compound represented by formula (I):

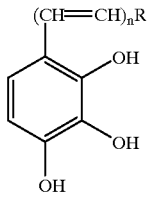

where n is 0 or 1; R is —(C═O)$R^1$, —(C═O)$NR^1R^2$, —CN, —$SO_3R^1$, —$SO_2R^1$, —$SOR^1$, —$SO_2NR^1R^2$ or —$PO_3R^1R^2$; $R^1$ is H or an alkyl, an aryl group; and $R^2$ is H or an alkyl or an aryl group; and $R^1$ and $R^2$ together can represent the atoms to close a ring.

3. Thermographic recording material according to claim 1, wherein said 1,2-dihydroxybenzene derivative is selected from the group consisting of: ethyl 3,4-dihydroxybenzoate, butyl 3,4-dihydroxybenzoate, 3,4-dihydroxybenzonitrile, 2,3,4-trihydroxy-acetophenone, 2,3,4-trihydroxy-propionophenone, 2,3,4-trihydroxybenzaldehyde, 2,3,4-trihydroxy-butyrophenone and 2,3,4-trihydroxybenzonitrile.

4. Thermographic recording material according to claim 1, wherein said polymer having active hydrogen atoms is selected from the group consisting of polyvinyl alcohol, polyvinyl acetals and proteinaceous binders.

5. Thermographic recording material according to claim 1, wherein said substantially light-insensitive organic silver salt is a silver salt of an aliphatic carboxylic acid having at least 12 carbon atoms.

6. Thermographic recording material according to claim 1, wherein protective layer contains a second polymer having active hydrogen atoms and a second polyisocyanate.

7. A recording process comprising the steps of: (i) bringing an outermost layer of a substantially light-insensitive black and white monosheet thermographic recording material into proximity with a heat source, said thermographic recording material comprising a support and a thermosensitive element provided with a protective layer, said thermosensitive element containing a substantially light-insensitive organic silver salt, a 1,2-dihydroxy-benzene derivative in thermal working relationship therewith and a polymer having active hydrogen atoms at least part of which has reacted with a first polyisocyanate selected from the group consisting of: hexamethylene diisocyanate, toluene diisocyanate, diphenylmethane diisocyanate, naphthylene diisocyanate and triphenylmethane-p,p',p"-trityl triisocyanate, wherein said protective layer being exclusive of fluorine-containing compounds and wherein said thermosensitive element being exclusive of propenenitrile compounds; and (ii) applying heat from said heat source imagewise to said thermographic recording material while maintaining proximity to said heat source to produce an image; and (iii) removing said thermographic recording material from said heat source.

8. Recording process according to claim 7, wherein said heat source is a thin film thermal head.

* * * * *